United States Patent [19]

Clarke et al.

[11] 4,263,792

[45] Apr. 28, 1981

[54] ROLLER DRIVE MECHANISMS

[75] Inventors: Joseph C. Clarke; Joseph E. Gamble, both of Leicester, England

[73] Assignee: Wildt Mellor Bromley Limited, Leicester, England

[21] Appl. No.: 917,190

[22] Filed: Jun. 20, 1978

[30] Foreign Application Priority Data

Jun. 24, 1977 United Kingdom.....26512/77

[51] Int. Cl.[3] ..... D04B 15/88

[52] U.S. Cl. ..... 66/151; 74/89; 139/304

[58] Field of Search ..... 74/89; 66/151, 152, 66/153; 139/304, 310

[56] References Cited

U.S. PATENT DOCUMENTS

| | | | |
|---|---|---|---|
| 3,220,222 | 11/1965 | Carrotte et al. | 66/151 |
| 3,433,034 | 3/1969 | Traumuller | 66/152 X |
| 4,027,506 | 6/1977 | Bitzer | 139/304 X |

FOREIGN PATENT DOCUMENTS

| | | |
|---|---|---|
| 454219 | 9/1936 | United Kingdom . |
| 1195372 | 6/1970 | United Kingdom . |
| 1359721 | 7/1974 | United Kingdom . |
| 1368530 | 9/1974 | United Kingdom . |
| 1407324 | 9/1975 | United Kingdom . |
| 1505468 | 3/1978 | United Kingdom . |

*Primary Examiner*—Louis Rimrodt

*Attorney, Agent, or Firm*—Buell, Blenko, Ziesenheim & Beck

[57] ABSTRACT

A roller drive mechanism for a knitting machine, in which the drive route is from a spring under tension via an oscillatory member and a one-way clutch to the roller. Means are provided for moving the oscillatory member in the reverse direction to re-tension the spring. The mechanism is suitable for driving a fabric winding down roller or a fabric roll-forming roller of the knitting machine.

10 Claims, 5 Drawing Figures

ROLLER DRIVE MECHANISMS

DESCRIPTION

Figure 1:
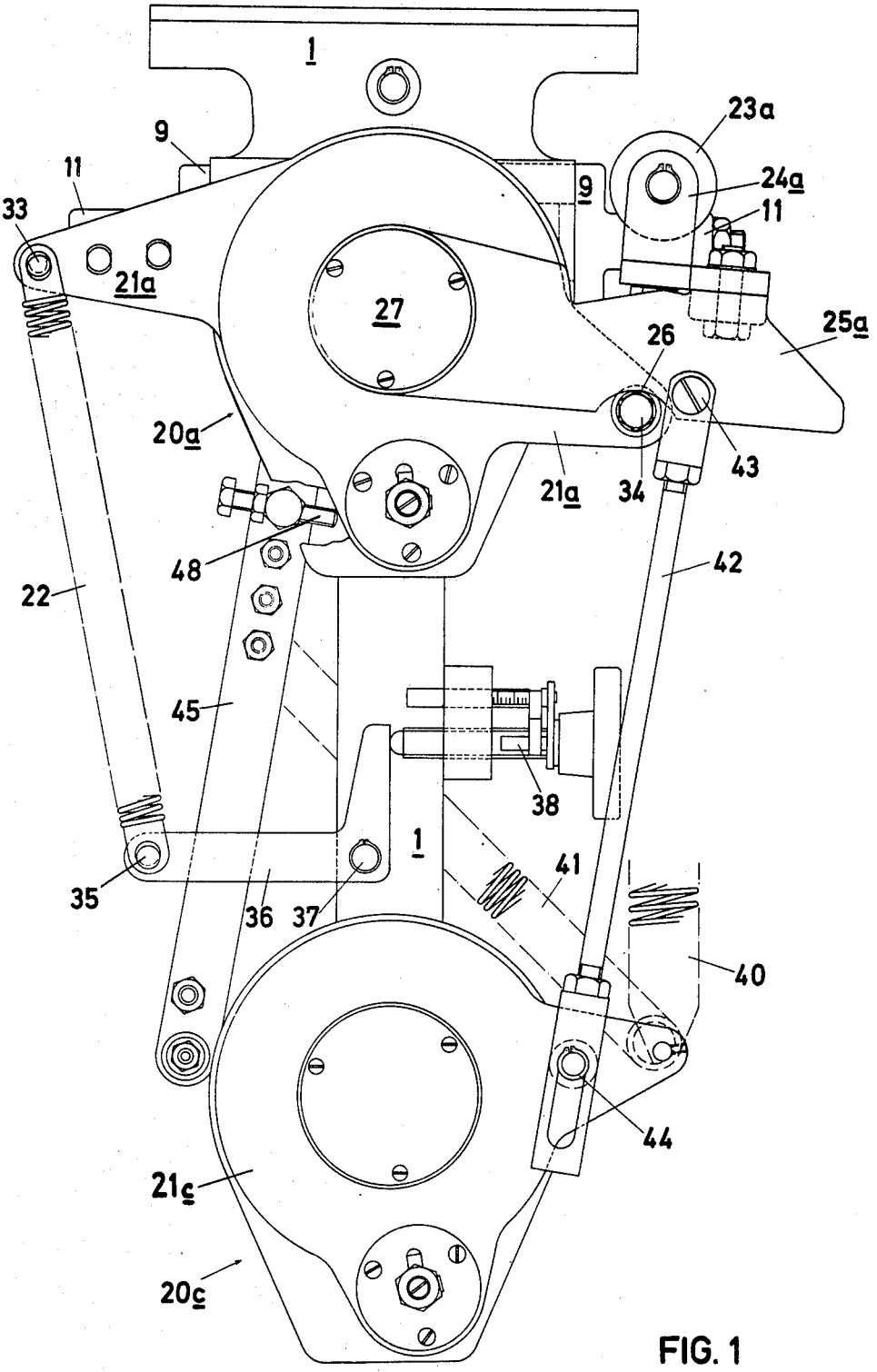

This invention relates to roller drive mechanisms, and particularly to drive mechanisms for fabric winding down rollers of a knitting machine and to drive mechanisms for rollers on which wound down fabric from a knitting machine is formed into a fabric roll.

It is usual to provide on a knitting machine at least two rollers between which fabric knitted on the machine is gripped and wound down, the fabric between the needles of the machine and the rollers thereby being given the necessary tension for the knitting action. Customarily only one of the rollers is positively driven, the other or others being idlers rotated by the positively driven roller. Drive for the positively driven roller has been derived from a suitable moving part of the knitting machine, for example, in a circular knitting machine having a rotary needle cylinder which necessitates the rollers rotating bodily with the needle cylinder from a fixed cam ring operating a cam follower, or, for futher example, in a circular knitting machine having a rotating cam box from a cam ring rotating with the cam box and operating a cam follower, the movement of the cam follower in either case being transmitted through a ratchet mechanism to drive the roller. It is desirable to keep the fabric tension constant as a fluctuating fabric tension is one cause of barring of the fabric, but it is difficult to do so in practice with such ratchet transmission roller drive mechanisms because of their inherent discontinuity of action. This is despite the use of two such ratchet transmission roller drive mechanisms, one at each end of the roller, operating out of phase with one another.

There is often provided on a knitting machine a roller on which wound down fabric from the machine is formed into a fabric roll for ease of handling and/or storage. Drive for this roller has been derived from ratchet transmission drive mechanisms similar to those described above. Fabric tension is less important in this case, and it is not usual to drive the roller at both ends, but it is nevertheless desirable to control the tension such that the fabric roll is sufficiently tightly wound not to occupy unnecessary space and to have a degree of rigidity suitable for easy handling, but not so tightly wound as to prevent withdrawal of the roller.

This invention provides a drive mechanism for a fabric winding down roller of a knitting machine or for a fabric roll forming roller of a knitting machine, the drive mechanism comprising an oscillatory member, a spring providing tension for moving the oscillatory member in one direction, means for moving the oscillatory member in the reverse direction to tension the spring, and transmission means including a one-way clutch for drivingly connecting the oscillatory member to the roller during movement of the oscillatory member in the said one direction and for disconnecting the oscillatory member from the roller during movement of the oscillatory member in the said reverse direction.

It has already been made clear that fabric tension is of considerable importance. The tension in the fabric is related to the residual tension in the spring after the completion of the movement of the oscillatory member in the said one direction, and fabrics of differing yarns have differing optimal tensions according to their stretch characteristics. Accordingly there is preferably provided in a drive mechanism according to this invention means for adjusting the tension of the spring. The particular nature of the adjusting means will vary depending upon whether the drive mechanism is to be used for a fabric winding down roller or a fabric roll forming roller, since the tension requirements differ in these two cases.

The tension requirement for a fabric winding down roller is, as previously stated, constant tension. Variation is only from fabric to fabric, and not during knitting of a single fabric. Hence the adjusting means may simply comprise means for moving the anchoring point of the end of the spring not operatively connected to the oscillatory member. For example, the spring may be anchored on a pivoted lever lockable in one of a plurality of positions.

The tension requirement for a fabric roll forming roller is ideally a comparatively low tension at small diameters of the fabric roll increasing with diameter to a comparatively high tension at large diameters of the fabric roll. This meets the above stated desiderata concerning space, rigidity and roller withdrawal. The adjusting means should therefore cause tension to increase with roll diameter. Although this could be achieved by moving the anchoring point of the end of the spring not operatively connected to the oscillatory member steadily away from the oscillatory member, it is found preferable to augment the spring by another spring anchored on a pivoted support bar of an idler roller contacting the fabric roll. As the fabric roll increases in diameter, the idler roller is moved away from the axis of the fabric roll forming roller and the pivoted support bar moves away from the oscillating member, so that increasing tension is applied to the augmentary spring.

In the case of drive mechanisms according to this invention for fabric winding down rollers, it is of course preferred to use two such mechanisms per knitting machine, one at each end of the fabric winding down rollers, operating 180° out of phase with one another, so that the rollers are driven by the spring relaxation of one of the drive mechanisms whilst the spring is being tensionsed in the other of the drive mechanisms and vice-versa.

The means for moving the oscillatory member in the reverse direction to tension the spring may, as in prior drive mechanisms, comprise a cam follower operable by a cam track over which it moves or which moves against it as appropriate to the particular knitting machine, and a lost motion connection between the cam follower and the oscillatory member. The lost motion connection is necessary since the knitting machine will be operable to knit different qualities of fabric thus producing different quantities of fabric, resulting in differing lengths of movement of the oscillatory member in the said one direction upon relaxation of the spring and requiring corresponding lengths of movement of the oscillatory member in the said reverse direction.

A suitable transmission means for a drive mechanism according to this invention may comprise a first toothed gear wheel carried by the oscillatory member, a second toothed gear wheel for location on the end of the roller, an externally and internally toothed gear ring meshing externally with the first toothed gear wheel and internally with the second toothed gear wheel, a first one-way clutch for locking the first toothed gear wheel during movement of the oscillatory member in the said one direction, and a second one-way clutch for locking the second toothed gear wheel during movement of the oscillatory member in the said reverse direction. In such an arrangement the first toothed gear wheel turns the gear ring during movement of the oscillatory member in the said one direction, but runs freely around the gear ring during movement of the oscillatory member in the said reverse direction, the gear ring being held stationary by the locked second toothed gear wheel.

If a knitting machine is provided with two drive mechanisms according to this invention, one for the fabric winding down roller and one for the fabric roll forming roller, to two drive mechanisms will of course require separate oscillatory members, springs and transmission means, but the means for moving the oscillatory members in the reverse directions to tension the springs may be common to both mechanisms, at least in part. For example, when as above described this means comprises a cam follower and a lost motion connection, the cam follower could be common to both drive mechanisms, with a separate lost motion connection for each drive mechanism.

Figure 2A:
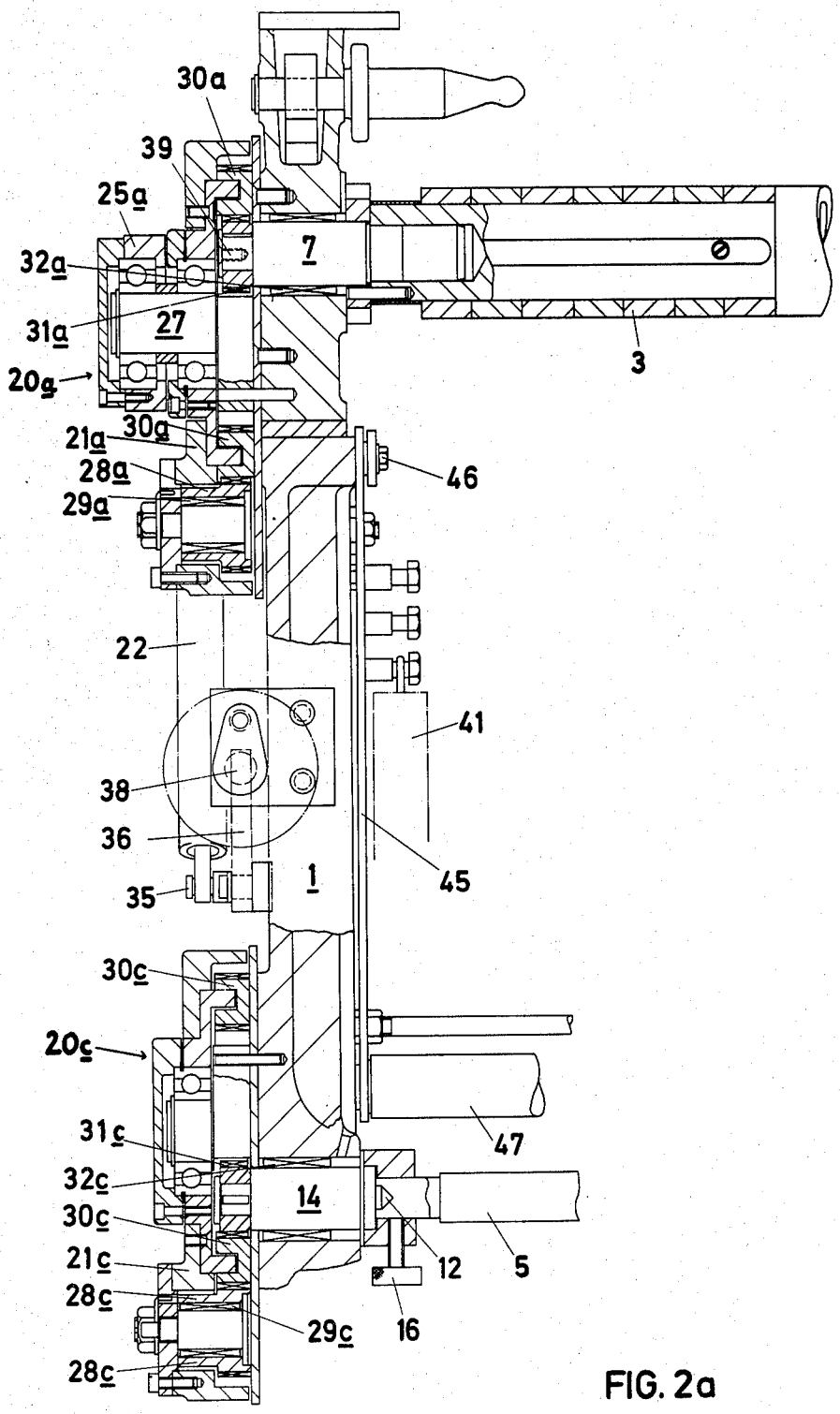
Figure 2B:
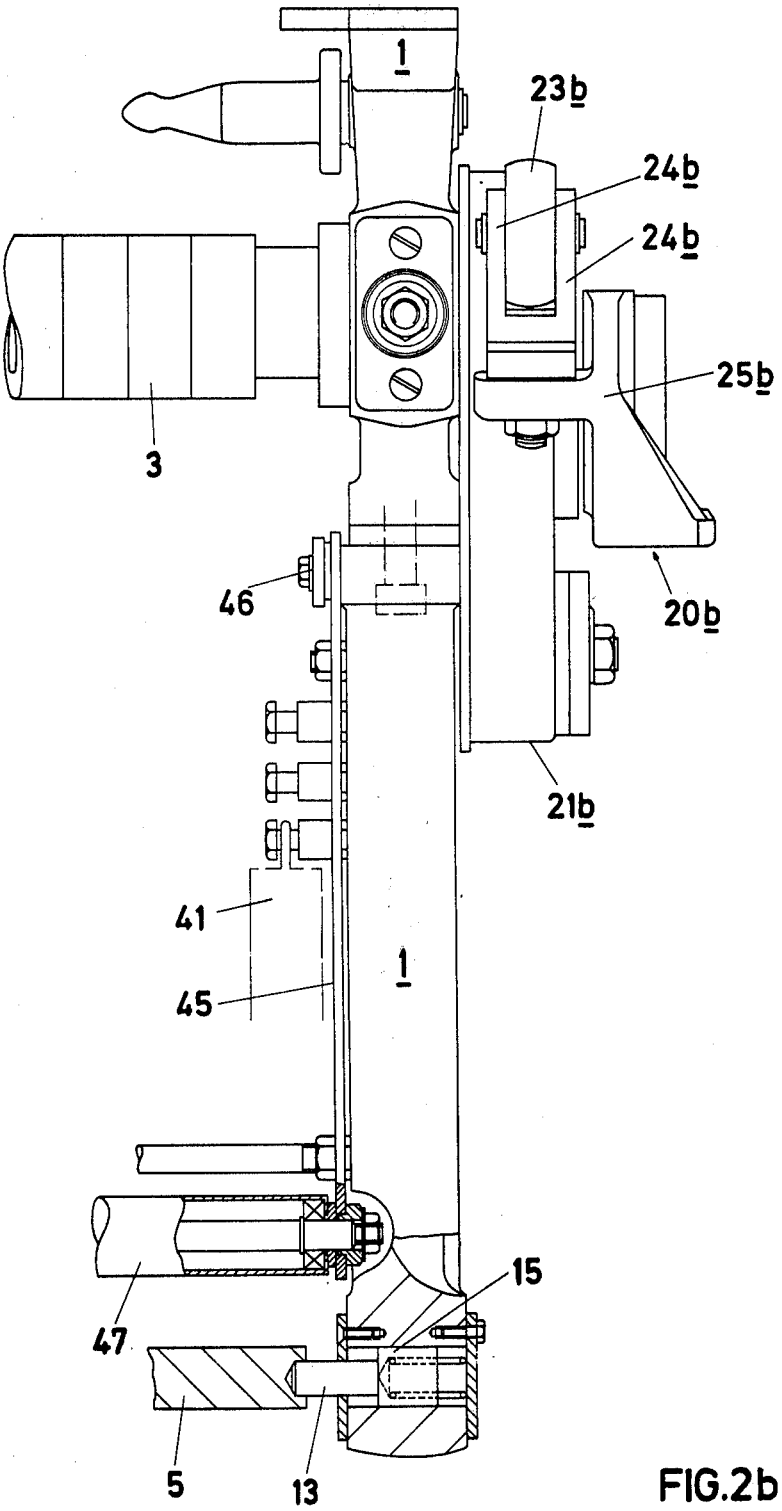
Figure 3:
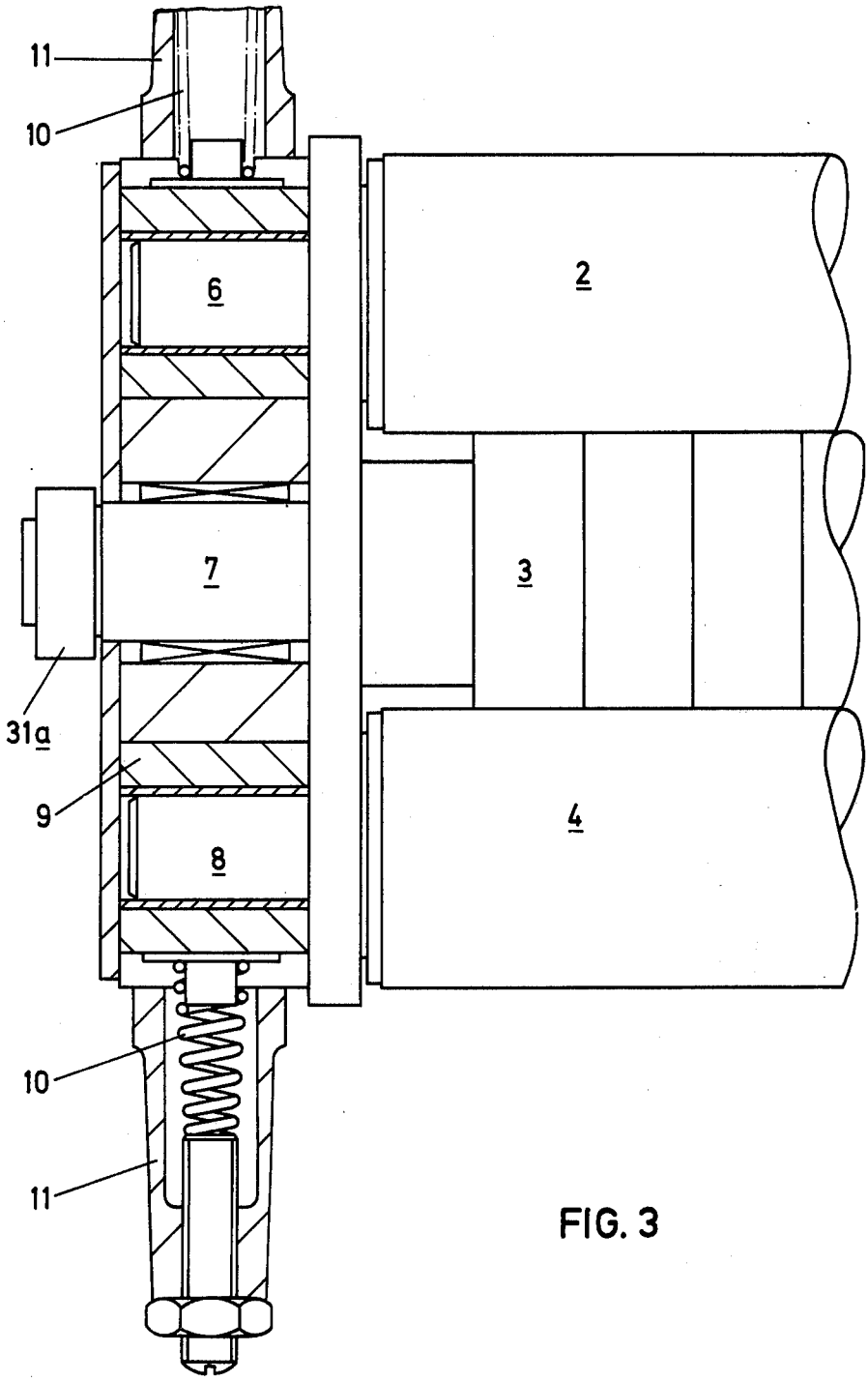
Figure 4:
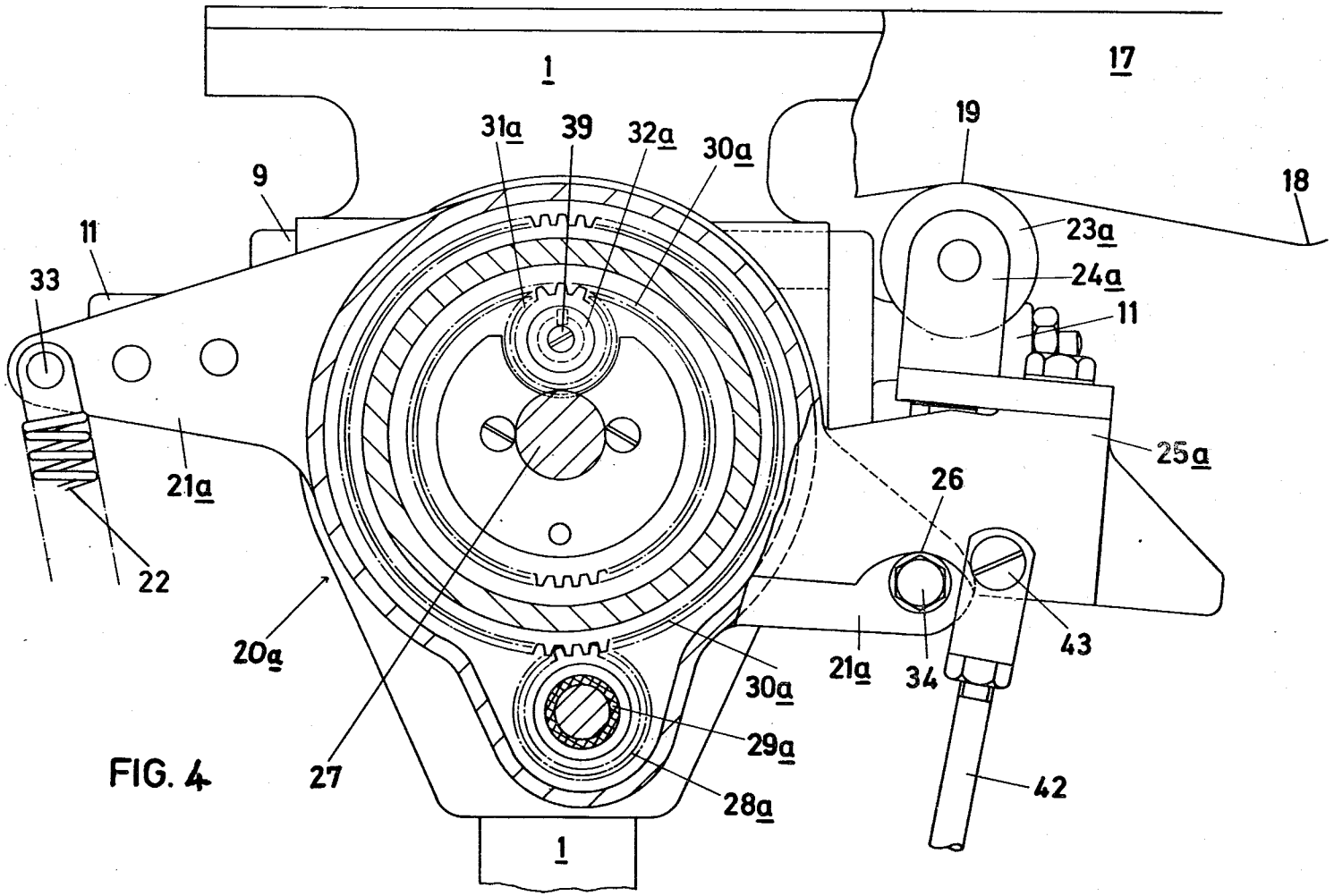

This invention is illustrated by the drawings, of which:

FIG. 1 is an end elevation of two drive mechanisms according to this invention, one for a fabric winding down roller and the other for a fabric roll forming roller;

FIGS. 2*a* and 2*b* are the left and right hand halves respectively of a partially sectional side elevation of the drive mechanisms of FIG. 1, the elevation also showing a third drive mechanism according to this invention for the fabric winding down roller;

FIG. 3 is a partially sectional top plan view of a part of the fabric winding down roller drive mechanism of FIG. 1; and FIG. 4 is a sectional end elevation of a part of the fabric winding down roller drive mechanism of FIG. 1.

The drive mechanisms shown in the drawings are for a knitting machine (not shown) having a rotating needle cylinder (not shown). The knitting machine is provided with a support 1 rotatable with the needle cylinder and mounting the drive mechanisms. Additionally the support mounts fabric winding down rollers 2, 3 and 4 (FIG. 3) and a fabric roll forming roller in the form of a squared shaft 5 (FIGS. 2*a* and 2*b*).

The fabric winding down roller 3 is positively driven at both its ends by drive mechanisms according to this invention as will appear hereinafter. The fabric winding down rollers 2 and 4 are idler rollers. The fabric winding down rollers 2, 3 and 4 are journalled at 6, 7 and 8 respectively (FIG. 3) in a housing 9 formed in the support 1, and are similarly mounted at their other ends. The rollers 2 and 4 are urged into frictional driving contact with the roller 3 by springs 10 in housings 11.

Stub axles 12 and 13 for the squared shaft 5 are journalled at 14 and 15 respectively in the support 1, see FIGS. 2*a* and 2*b*. The stub axle 13 is spring loaded and the stub axle 12 is held fast with the squared rod 5 by a screw 16. The squared shaft 5 can therefore be removed by undoing the screw 16 and pushing the squared shaft 5 to the right (as shown in FIG. 2*a*) against the spring loading (FIG. 2*b*).

The knitting machine is also provided with a fixed cam ring 17, shown in FIG. 4. The cam ring 17 has alternate peaks 18 and troughs 19, arranged so that each of the peaks 18 is approximately at 180° to one of the troughs 19. Shown in the drawings are three drive mechanisms according to this invention, indicated generally at 20*a*, 20*b* and 20*c*. Parts in the drive mechanisms 20*a*, 20*b* 20*c* which have similar forms and functions have been given the same reference numerals, suffixed with the letter a, b or c appropriate to the drive mechanism of which they are parts.

The drive mechanism 20*a* comprises an oscillatory member 21*a* pivotally mounted at 27; a spring 22; means for moving the oscillatory member 21*a* to tension the spring 22 which means comprise a roller cam follower 23*a* journalled in plates 24*a* bolted to a mounting member 25*a* having a seat 26 and also being pivotally mounted at 27; and transmission means comprising a toothed gear wheel 28*a* provided internally with a one-way clutch 29*a*, an externally and internally toothed gear ring 30*a*, and a toothed gear wheel 31*a* fixed to the end of the roller 3 journalled at 7, the end of the roller 3 being provided with a one-way clutch 32*a* around the journalling 7.

The oscillatory member 21*a* carries an anchor nut 33 for the spring 22, a buffer 34 for seating in the seat 26, and the gear wheel 28*a*.

The spring 22 is anchored by a nut 35 to an L-shaped lever 36 pivoted to the support 1 at 37. A screw device 38 can be tightened or loosened to move the lever 36 about its pivotal mounting 37.

The gear ring 30*a* meshes externally with the gear wheel 28*a* and internally with the gear wheel 31*a* which is retained by a screw 39 (FIG. 2*a*) and keyed to the end of the roller 3 journalled at 7.

The operation of the drive mechanism 20*a* will now be described with reference to FIG. 4, clockwise and anticlockwise meaning clockwise and anticlockwise as shown in FIG. 4. The cam follower 23*a*, beginning from a trough 19, moves along the cam ring 17 towards a peak 18. The mounting member 25*a* therefore moves clockwise about its pivotal mounting at 27, and the seat 26 bears against the buffer 34 to move the oscillatory member 21*a* in a clockwise direction about its pivotal mounting at 27. The gear wheel 28*a* rotates in a clockwise direction (the one-way clutch 29*a* being adapted to lock the gear wheel 28*a* against anticlockwise rotation) and runs around the gear ring 30*a* which is being rotated in the opposite direction by means which will be described later. The one-way clutch 32*a* thus disconnects the oscillatory member 21*a* from the roller 3 during the clockwise movement of the oscillatory member 21*a* which loads the spring 22. When the cam follower 23*a* passes over a peak 18, and descends towards the next trough 19, the mounting member 25*a* moves anticlockwise about its pivotal mounting at 27, since it is biased in that direction by a spring (not shown) attached to it at one end and at the other end to a gear ring (not shown) carrying the support 1 to keep the cam follower 23*a* on the cam ring 17.

This anticlockwise movement of the mounting member 25*a* releases the buffer 34 from engagement with the seat 26, thereby allowing anticlockwise movement of the oscillatory member 21*a* under the tension of the spring 22. The gear wheel 28*a* is, however, locked against anticlockwise rotation and therefore turns the gear ring 30*a* anticlockwise and the gear wheel 31*a* anticlockwise, thus turning the roller 3.

The anticlockwise movement of the mounting member 25*a* continues until the cam follower 23*a* reaches a trough 19. The anticlockwise movement of the oscillatory member 21*a* is, however, limited by the amount of fabric which has been knitted and is therefore available for winding down. Thus the buffer 34 may unseat from the seat 26, and there is effectively a lost motion relationship between the members 21*a* and 25*a*. The tension in the fabric is dependent upon the residual tension in the spring 22 and this can be adjusted by the screw device 38.

The drive mechanism 20*b* is identical to the drive mechanism 20*a*, but will operate out of phase with the drive mechanism because the cam follower 23*b* is at a peak 18 when the cam follower 23*a* is at a trough, a consequence of their being approximately 180° apart. It is this "out of phase" operation of the roller drive which has previously caused trouble with ratchet mechanisms as mentioned hereinbefore, because at the instant that one drive takes over from the other back-lash can occur. In the present invention the one-way clutches 32*a* associated with the journals 7 allow the drive to alternate from one end to the other end of roller 3 without allowing the roller momentarily to slip back under the tension of the fabric.

The drive mechanism 20*c* for the squared shaft 5 comprises an oscillatory member 21*c* and a transmission means comrpising gear wheels 28*c* and 31*c*, one-way clutches 29*c* and 32*c* and a gear ring 30*c*, arranged as are the corresponding parts in the drive mechanism 20*a*. The drive mechanism 20*c* also comprises springs 40 and 41, and means for moving the oscillatory member 21*c* to tension the springs 40 and 41. The said means comprise the cam follower 23*a*, plates 24*a* and mounting member 25*a*, together with a rod 42 pivoted at 43 to the mounting member 25*a* and having a lost motion connection 44 to the oscillatory member 21*c*. The springs 40 and 41 are attached at one end to a rod extending perpendicularly from the oscillatory member 21*c* (FIG. 2*a*). At its other end the spring 40 is attached to the gear ring carrying the support 1. The spring 41 is attached at its other end to one of a pair of flat bars 45 which are pivoted to the support 1 at 46 and carry a free running roller 47. The one of the flat bars 45 rests under gravity against the support 1 via an adjusting screw 48, until the fabric roll is of sufficient diameter to abut the free running roller 47.

The operation of the drive mechanism 20*c* is similar to that of the drive mechanism 20*a*. Clockwise movement of the mounting member 25*a*, derived as above described, is applied through the rod 42 and lost motion connection 44 to the oscillatory member 21*c* to rotate it clockwise, the gear wheel 28*c* then running freely around the gear ring 30*c*. Anticlockwise movement of the mounting member 25*a* allows the spring 40 to contract until the fabric is wound onto the fabric roll on the squared shaft 5 driven by rotation of the gear wheel 31*c*, as the gear wheel 28*c* is then locked.

As the fabric roll on the squared shaft 5 increases in diameter, the roller 47 is moved away from the axis of the squared shaft 5, pivotting the flat bars 45 about their mountings 46. This tensions the spring 41. The tension applied to the fabric is related to the residual tensions in the springs 40 and 41 and therefore in this arrangement increases as the fabric roll diameter increases.

We claim:

1. A drive mechanism for either of a fabric winding down roller of a knitting machine or a fabric roll forming roller of a knitting machine, the drive mechanism comprising an oscillatory member, a spring providing tension for moving the oscillatory member in one direction, means for moving the oscillatory member in the reverse direction to tension the spring, a first toothed gear carried by the oscillatory member, a second toothed gear drivingly connected to the end of the roller, a third toothed gear meshing with the first toothed gear and with the second toothed gear, a first one-way clutch for drivingly connected the oscillatory member to the roller during movement of the oscillatory member in the said one direction by locking the first toothed gear and for disconnecting the oscillatory member in the said reverse direction, and a second one-way clutch for locking the second toothed gear and hence the roller against reverse rotation during movement of the oscillatory member in the said reverse direction.

2. A drive mechanism according to claim 1 further comprising means for adjusting the tension of the spring.

3. A drive mechanism according to claim 2 and being for a fabric winding down roller of a knitting machine, wherein the means for adjusting the tension of the spring comprise means for moving the anchoring point of the end of the spring not operatively connected to the oscillatory member.

4. A drive mechanism according to claim 3 wherein the end of the spring not operatively connected to the oscillatory member is anchored on a pivoted lever positionable in one of a plurality of positions.

5. A drive mechanism according to claim 2 and being for a fabric roll forming roller of a knitting machine wherein the means for adjusting the tension of the spring are effective to cause tension to increase with roll diameter.

6. A drive mechanism according to claim 5 wherein the means for adjusting the tension of the spring comprise another spring anchored on a pivoted support bar of an idler roller contacting, in use, the fabric roll, so that as the fabric roll increases in diameter the idler roller is moved away from the axis of the fabric roll forming roller and the pivoted support bar moves away from the oscillating member whereby increasing tension is applied to the augmentary spring.

7. A drive mechanism according to claims 1 or 2 or 3 or 4 or 5 or 6 wherein the means for moving the oscillatory member in the reverse direction to tension the spring comprise a cam follower operable by a cam track over which it moves or which moves against it, and a lost motion connection between the cam follower and the oscillatory member.

8. A drive mechanism according to claim 1 in which the third toothed gear is a ring gear meshing externally with the first toothed gear and internally with the second toothed gear.

9. A pair of drive mechanisms for a fabric winding down roller of a knitting machine, each said drive mechanism of the pair being according to any of claims 1 or 2 or 3 or 4 or 7 or 8 and operating 180° out of the phase with the other drive mechanism of the pair so that the roller is driven by the spring relaxation of one of the drive mechanisms while the spring is being tensioned in the other of the drive mechanisms and vice versa.

10. A pair of drive mechanisms for a fabric winding down roller of a knitting machine, each of said drive mechanisms of the pair being according to claim 7 and operating 180° out of the phase with the other drive mechanism of the pair so that the roller is driven by the spring relaxation of one of the drive mechanisms while the spring is being tensioned in the other of the drive mechanisms and vice versa.

* * * * *

UNITED STATES PATENT AND TRADEMARK OFFICE

CERTIFICATE OF CORRECTION

PATENT NO. : 4,263,792

DATED : April 28, 1981

INVENTOR(S) : JOSEPH C. CLARKE and JOSEPH E. GAMBLE

It is certified that error appears in the above-identified patent and that said Letters Patent are hereby corrected as shown below:

Column 3, line 12, "to" should read --the--.

Column 4, line 2, after "20b", --and-- should be inserted.

Column 5, line 22, "comrpising" should be --comprising--.

Column 6 (claim 9), line 55, "or 7" should be deleted.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*